US006040101A

United States Patent [19]

Naka et al.

[11] Patent Number: 6,040,101

[45] **Date of Patent: *Mar. 21, 2000**

[54] CARRIER PARTICLES FOR USE IN ELECTROSTATIC IMAGE DEVELOPMENT AND ELECTROSTATIC IMAGE DEVELOPER

[75] Inventors: Akio Naka, Takatsuki; Tetsuya Yamamoto, Suita; Yoshikuni Mori, Takatsuki, all of Japan

[73] Assignee: Nippon Shokubai Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/871,578

[22] Filed: Jun. 9, 1997

[30] Foreign Application Priority Data

Jun. 10, 1996 [JP] Japan ..... 8-147386

[51] Int. Cl.[7] ..... G03G 9/113

[52] U.S. Cl. ..... 430/108; 430/106.6; 430/111

[58] Field of Search ..... 428/405, 407; 430/111, 108, 106.6

[56] References Cited

U.S. PATENT DOCUMENTS

| | | | |
|---|---|---|---|
| 5,342,721 | 8/1994 | Akamatsu | 430/108 |
| 5,397,668 | 3/1995 | Sato et al. | 430/108 |
| 5,885,741 | 3/1999 | Akamastu et al. | 430/106.6 |

FOREIGN PATENT DOCUMENTS

| | | |
|---|---|---|
| 35-16031 | 10/1960 | Japan . |
| 59-223460 | 12/1984 | Japan . |
| 7-104522 | 4/1995 | Japan . |
| 7-160058 | 6/1995 | Japan . |

OTHER PUBLICATIONS

Morrison & Boyd, *Organic Chemistry*, 3rd Edition, Allyn & Bacon, Inc, Boston (Jun. 1979) pp 79–80.

*Primary Examiner*—Janis L. Dote

*Attorney, Agent, or Firm*—Oblon, Spivak, McClelland, Maier & Neustadt, P.C.

[57] ABSTRACT

A carrier particle which includes a core and a coating layer formed on the surface of the core. The coating layer is made of a coating material including: an organic compound (A) having a functional group other than an $Si(OR^1)$ group, where $R^1$ is a hydrogen atom, a lower alkyl group or an acyl group; a compound (B) and/or a hydrolytic condensation product thereof, having a functional group having reactivity with the functional group of the organic compound (A), and an $Si(OR^1)$ group; an organometallic compound (C) and/or a hydrolytic condensation product thereof; and a solvent (D). The carrier particles of the present invention, enable toner particles to be sufficiently charged even at high temperature and high humidity, so that an image with no fog can be formed. In addition, the carrier particle has high durability. There is no unnecessary attachment of the toner particles onto the carrier particles, so that the problems of carrier particle contamination and spent toner never arise.

29 Claims, No Drawings

CARRIER PARTICLES FOR USE IN ELECTROSTATIC IMAGE DEVELOPMENT AND ELECTROSTATIC IMAGE DEVELOPER

BACKGROUND OF THE INVENTION

The present invention relates to carrier particles for use in electrostatic image development, and an electrostatic image developer including the same. The carrier particles are included, together with toner particles, in a two-component system developer which is a kind of dry type developer used in an electrophotographic copying machine and the like.

A two-component system developer used in electrophotography includes toner particles and carrier particles. The toner particles are in a form of powder which make an electrostatic latent image on a photoreceptor visible. The toner particles include a binder resin such as a styrene-acrylic copolymer and a polyester-type resin, and pigment such as carbon black and the like as an essential component. Carrier particles play several roles such as to convey toner particles to a developing area, to produce friction with toner particles so that toner particles are charged, to be used as electrodes in the development of an electrostatic latent image, and to remove unnecessary toner particles on the photoreceptor. Examples of carrier particles include magnetic powder such as iron powder, ferrite and the like. Recently, using such magnetic powder as a core, the magnetic powder is coated with a resin-type coating material, and thus-obtained carrier particles have coming into wide use.

Conventionally, a coating material including a silicone resin, a fluoro resin, and the like as an essential component has been mainly used due to their low adhesiveness to a binder resin (for example, a polystyrene resin, polyester, or a styrene-acrylic resin, and the like) contained in toner particles. These resins have been used for the purpose of avoiding the attachment between toner particles and carrier particles. If the toner particles attach onto the carrier particles, there are problems of the spent toner, and the contamination of the carrier particles by the toner particles so that the toner particles are not sufficiently charged by friction.

When the coating layer is made of a coating material containing these resins having low adhesivness, however, the coating layer has only low adhesiveness to the core of the carrier particle. With weak adhesivenss, a coating layer is likely to peel off the core, so that the electric resistance of the carrier particle is decreased and the charge level of the toner particle changes with time. In order to solve such problems, there have been suggestions to use a coating material including a silane coupling agent alone or in a mixture with a silicone resin. For example, Japanese Patent Publication No. 7-19079 suggests the use of a coating material including silane coupling agent alone. Japanese Laid-Open Patent Publiation No. 7-160058 suggests the use of a coating material including a silane coupling agent and alkoxysiloxane. Japanese Laid-Open Patent Publication No. 7-104522 suggests the use of a coating material including a silane coupling agent and a silicone resin.

The organic coating layer made of such coating materials has relatively enhanced adhesiveness to the inorganic core; however, is poor in abrasion resistance and impact resistance, so that during repeated use, the coating layer peel off the core. The carrier particle with such a coating layer is poor in durability. There is also a problem remaining unsolved that the toner particles are not sufficiently charged by friction at high temperature under high humidity, so that the obtained image has fog.

The prevent invention has been conducted to solve the above-described problems, and the objective thereof is to provide carrier particles excellent in durability, with which a clear image with no fog can be formed for a long period of time even at high temperature under high humidity as well as at normal temperature under normal humidity.

SUMMARY OF THE INVENTION

According to the present invention, a carrier particle for use in electrostatic image development includes a core and a coating layer formed on the surface of the core, wherein the coating layer is made of a coating material comprising:

(A) an organic compound having a functional group other than an $Si(OR^1)$ group, where $R^1$ is a hydrogen atom, a lower alkyl group or an acyl group;

(B) a compound and/or a hydrolytic condensation product thereof, having a functional group having reactivity with the functional group of the organic compound (A) and an $Si(OR^1)$ group, where $R^1$ is a hydrogen atom, a lower alkyl group or an acyl group;

(C) an organometallic compound of the formula (C) and/or a hydrolytic condensation product thereof:

$$R^2_mM(OR^3)_n \quad (C)$$

wherein M is Si or a metal element; $R^2$ is the same or different hydrogen atom, a lower alkyl group, an allyl group; $R^3$ is the same or different hydrogen atom, a lower alkyl group, or an acryl group; m is 0 or a positive integer; n is an integer of 1 or more; and (m+n) is equal to the valency of metal element M; and (D) a solvent.

A coating layer made of the coating material of the present invention does not peel off the core of the carrier particle, so that the carrier particle has enhanced durability. In addition, the toner particle is sufficiently charged by friction with the carrier particle even at high temperature under high humidity, thereby forming a clear image with no fog.

DETAILED DESCRIPTION OF THE PREFERRED EMBODIMENT

According to the present invention, a carrier particle for use in electrostatic image development includes a core and a coating layer formed on the surface of the core, wherein the coating layer is made of a coating material comprising:

(A) an organic compound having a functional group other than an $Si(OR^1)$ group, where $R^1$ is a hydrogen atom, a lower alkyl group or an acyl group;

(B) a compound and/or a hydrolytic condensation product thereof, having a functional group having reactivity with the functional group of the organic compound (A) and an $Si(OR^1)$ group, where $R^1$ is a hydrogen atom, a lower alkyl group or an acyl group;

(C) an organometallic compound of the formula (C) and/or a hydrolytic condensation product thereof:

$$R^2_mM(OR^3)_n \quad (C)$$

wherein M is Si or a metal element; $R^2$ is the same or different hydrogen atom, a lower alkyl group, an allyl group; $R^3$ is the same or different hydrogen atom, a lower alkyl group, or an acryl group; m is 0 or a positive integer; n is an integer of 1 or more; and (m+n) is equal to the valency of metal element M; and (D) a solvent.

The carrier particle of the present invention is provided with a coating layer made of a coating material including a reactive organic compound (A). The coating layer has excellent impact resistance as compared with that of the conventional carrier particle. In addition, using the carrier particle with the coating layer of the present invention, the toner is charged sufficiently even at high temperature under high humidity. Moreover, by combining the compounds (A), (B), and (C), the coating layer is tightly crosslinked and firmly adheres to the core of the carrier particle, so that the various properties of the carrier particle such as heat resistance are enhanced.

Preferably, an organic compound (A) is a compound having two or more functional groups, and the preferable functional groups are epoxy groups or amino groups.

In one preferable embodiment, the organic compound (A) is a compound having two or more epoxy groups (the compound may be a polymer.). Specifically, if the organic compound (A) is a diglycidyl compound having an aromatic ring or a hydrogen addition ring thereof, there is no deterioration of the properties of the carrier particles even at high temperature under high humidity. The compound (B) has a functional group having reactivity with the compound (A) regardless of the kind of functional group of the organic compound (A). Accordingly, when the coating layer of the carrier particles is made of a coating material including the organic compound (A) and the compound (B), the coating layer has excellent properties such as the flexibility, hardness, ability to allow the toner to be charged, heat resistance, and the like. When the organic compound (A) has an epoxy group, the compound (B) preferably has an amino group, because the reactivity therebetween is excellent, so that a tight coating layer can be formed.

In another preferable embodiment, the organic compound (A) is polyethyleneimines. The use of such an organic compound (A) gives flexibility to the coating layer to enhance its impact resistance while keeping other properties excellent. In this case, the compound (B) preferably has an epoxy group as a functional group. In the combination of such compounds (A) and (B), a tight coating layer can be formed for a short time.

The coating material used for forming the coating layer of the carrier particles may include a cohydrolytic condensation product of the compound (B) with an organometallic compound (C). The coating material may include a silicone resin (E). The present invention is also directed to an electrostatic image developer comprising the carrier particles and the toner particles.

Hereinafter, the present invention will be described in more detail.

The organic compound (A) is not specifically limited as far as it is an organic compound having a functional group other than $Si(OR^1)$ group, where $R^1$ is a hydrogen atom, a lower alkyl group, or an acyl group. Having no $Si(OR^1)$ group, the organic compound (A) is not related to the hydrolytic condensation reaction between the compound (B) and an organic metallic compound (C), which will be described later in detail.

In the prior art, the formation of the coating layer has relied on only the hydrolytic condensation reaction using a coating material including silane coupling agent. Whereas thus-obtained coating layer has high tightness, it is brittle and poor in impact resistance. Contrary to this, according to the present invention, the coating material includes the organic compound (A), so that the soft and flexible coating layer with high impact resistance and the abrasion resistance can be formed on the core of the carrier particles. In spite that the organic compound (A) is not related to the hydrolytic condensation reaction between the compound (B) and the organometallic compound (C), the functional group in the compound (A) react with the functional group in the compound (B). As a result, the organic compound (A) is taken into the high-molecular chain constituting the coating layer, and makes a soft segment portion in the chain. In this manner, the carrier particle is provided with a coating layer having enhanced impact resistance without impairing its hardness, strength, and tightness.

The organic compound (A) is required to have a functional group other than $Si(OR^1)$ group where $R^1$ is a hydrogen atom, a lower alkyl group or an acyl group. The functional group in the organic compound (A) is not limited to a specific kind, and may be of various kinds depending on the functional group of the compound (B) to be reacted therewith. Preferably, when the organic compound (A) has an epoxy group as a functional group, the compound (B) has an amino group as a functional group, and when the organic compound (A) has an amino group as a functional group, the compound (B) has an epoxy group as a functional group. This is because an amino group and an epoxy group react with each other at high speed, and therefore, the coating layer is hardened for a short time. It is also effective for hardening the coating layer for a short time that the compound (A) has two or more functional groups. In addition, if an amino group is present in either the compound (A) or the compound (B), the toner is charged sufficiently, especially in the build-up time thereof.

The organic compound (A) preferably is a polymer having 200 or more of molecular weight in order to form a soft segment portion which renders the coating layer flexible. Examples of especially preferable compound include polyethyleneimines. In this case, the compound (B) is preferably a compound having an epoxy group. Or alternatively, the compound (B) may have other kind of functional group which reacts with an amino group contained in the polyethyleneimines such as an isocyanate group, an oxazolinyl group, an alkyl halide group, a carboxyl group or an anhydride group thereof, an hydroxyl group, and the like.

Specific examples of the organic compound (A) having an amino group include: low-molecular organic compounds having one or more amino group such as allylamine, diallylamine, isopropylamine, diisopropylamine, imino-bispropylamine, ethylamine, diethylamine, 2-ethylhexylamine, 3-ethoxypropylamine, diisobutylamine, 3-diethylaminopropylamine, di-2-ethylhexylamine, dibutylaminopropylamine, propylamine, dimethylaminopropylamine, methyliminobispropylamine, 3-methoxypropylamine, ethylenediamine, 1,4-diaminobutane, 1,2-diaminopropane, 1,3-diaminopropane, hexamethylenediamine, ethanolamine, diethanolamine and the like; organic polymers, for example, polyethyleneimines such as EPOMIN series (EPOMIN SP-003, EPOMIN SP-006, EPOMIN SP-012, EPOMIN SP-018, EPOMIN SP-103, EPOMIN SP-110, EPOMIN SP-200, EPOMIN SP-300, EPOMIN SP-1000, EPMIN SP-1020 and the like; product names, manufactured by Nippon Shokubai Co.); polyallylamine (for example, PAA-L, PAA-H, and the like; product names, manufactured by Nitto Boseki Co.);

homopolymers of amino group-containing (meth)acrylate such as dimethylaminoethyl(meth)acrylate, diethylaminoethyl(meth)acrylate and the like; copolymers of amino group-containing (meth)acrylate and other (meth) acrylates or (meth)acrylic acid; and polyoxyethylenealkylamine and the like.

The compound (A) may be a compound having an epoxy group. In this case, the compound (B) preferably has an amino group as a functional group, or alternatively may have a carboxyl group, a hydroxyl group, a mercapto group, and the like as a functional group.

Specific examples of the organic compound (A) having an epoxy group include: aliphatic diglycidyl ethers such as ethylene glycol diglycidyl ether, diethylene glycol diglycidyl ether, triethylene glycol diglycidyl ether, tetraethylene glycol diglycidyl ether, nonaethylene glycol diglycidyl ether, propylene glycol diglycidyl ether, dipropylene glycol diglycidyl ether, tripropylene glycol diglycidyl ether, 1,6-hexanediol diglycidyl ether, neopentyl glycol diglycidyl ether, glycerol diglycidyl ether and the like; polyglycidyl ethers such as glycerol triglycidyl ether, diglycerol triglycidyl ether, triglycidyl tris(2-hydroxyethyl) isocyanurate, trimethylolpropane triglycidyl ether, pentaerythritol tetraglycidyl ether and the like; aliphatic or aromatic diglycidyl esters such as diglycidyl adipate, diglycidyl o-phthalate and the like; glycidyl compounds having an aromatic ring or a hydrogenated ring thereof (including nucleus-substituted derivatives) such as bisphenol A diglycidyl ether, resorcinol diglycidyl ether, hydroquinone diglycidyl ether, bisphenol S diglycidyl ether, bisphenol F diglycidyl ether, compounds represented by the following formulae:

[Chemical Formula 1]

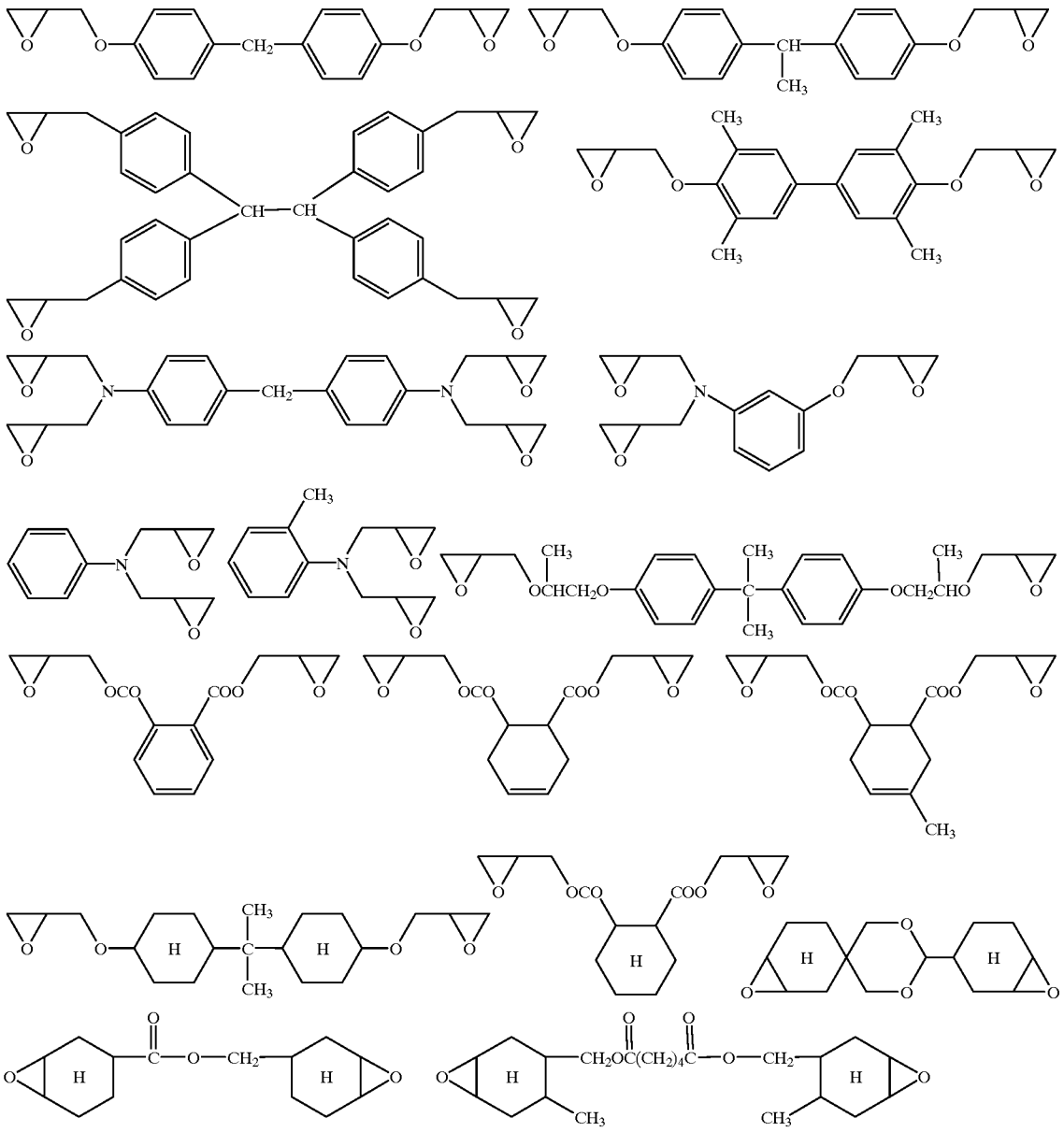

oligomers having glycidyl groups as functional groups such as bisphenol A diglycidyl ether oligomer represented by the following formula:

[Chemical Formula 2]

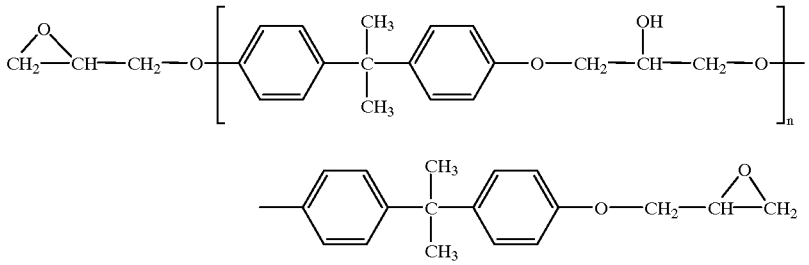

$n$ = 0 or an integer of 1 or more

Among these compounds used as the compound (A), a diglycidyl compound having an aromatic ring or a hydrogenated ring thereof (including nucleus-substituted derivatives) is one of the most preferable compound. Using a diglycidyl compound as the compound (A), the toner is sufficiently charged even at high temperature under high humidity, thereby forming an image with no fog.

The compound (B) is a compound having the functional group having reactivity with the functional group in the organic compound (A), and $Si(OR^1)$, where $R^1$ is a hydrogen atom, a lower alkyl group or an acyl group.

Examples of the compound (B) include N-β-(aminoethyl)-γ-aminopropyltrimethoxysilane, N-β-(aminoethyl)-γ-aminopropyltriethoxysilane, N-β-(aminoethyl)-γ-amino-propyltriisopropoxysilane, N-β-(aminoethyl)-γ-amino-propyltributoxysilane, N-β-(aminoethyl)-γ-amino-propylmethyldimethoxysilane, N-β-(aminoethyl)-γ-amino-propylmethyldiethoxysilane, N-β-(aminoethyl)-γ-aminopropylmethyldiisopropoxysilane, N-β-(aminoethyl)-γ-aminopropylmethyldibutoxysilane, N-β-(aminoethyl)-γ-aminopropyl-ethyldimethoxysilane, N-β-(aminoethyl)-γ-amino-propyl-ethyl-diethoxysilane, N-β-(aminoethyl)-γ-aminopropylethyldiisopropoxysilane, N-β-(aminoethyl)-γ-aminopropylethyldibutoxysilane, γ-amino-propyltrimethoxysilane, γ-aminopropyltriethoxysilane, γ-amino-propyl-triisopropoxysilane, γ-amino-propyl-tributoxysilane, γ-amino-propyl-methyldimethoxysilane, γ-amino-propyl-methyldiethoxysilane, γ-amino-propyl-methyldiisopropoxysilane, γ-aminopropylmethyldibutoxysilane, γ-amino-propylethyldimethoxysilane, γ-amino-propyl-ethyldiethoxysilane, γ-amino-propyl-ethyldiisopropoxysilane, γ-amino-propyl-ethyldibutoxysilane, γ-amino-propyl-triacetoxysilane, γ-(2-ureidoethyl)amino-propyl-trimethoxysilane, γ-(2-ureidoethyl)amino-propyl-triethoxysilane, γ-ureidopropyltriethoxysilane, N-β-(N-vinylbenzilaminoethyl)-γ-amino-propyl-trimethoxysilane and the like:

compounds having an epoxy group such as β-(3,4-epoxycyclohexyl) ethyl-trimethoxysilane, β-(3,4-epoxycyclohexyl) ethyl-triethoxysilane, β-(3,4-epoxycyclohexyl) ethyl-triisopropoxysilane, β-(3,4-epoxycyclohexyl) ethyl-methyl-dimethoxysilane, β-(3,4-epoxycyclohexyl) ethyl-methyl-diethoxysilane, γ-glycidoxy-propyl-trimethoxysilane, γ-glycidoxy-propyl-triethoxysilane, γ-glycidoxy-propyl-triisopropoxysilane, γ-glycidoxy-propyl-methyl-dimethoxysilane, γ-glycidoxy-propyl-methyl-diethoxysilane and the like; and compounds having an isocyanate group such as γ-isocyano-propyl-trimethoxysilane, γ-isocyano-propyl-triethoxysilane, γ-isocyano-propyl-methyl-dimethoxysilane, γ-isocyano-propyl-methyl-diethoxysilane and the like; compounds having a mercapto group such as γ-mercapto propyltrimethoxysilane, γ-mercaptopropyltriethoxysilane, and the like. These compounds may be used alone or in a mixture of two or more of them.

As described above, the compound (B) has a functional group having reactivity with the organic compound (A), and a hydrolyzable $Si(OR^1)$ group. Therefore, the compound (B) undergoes hydrolytic condensation polymerization before or after reacting with the organic compound (A). Simultaneously, the compound (B) undergoes cohydrolytic condensation with the hydrolyzable group contained in the organometallic compound (C), so that the condensation polymerization between the compound (B) and the organometallic compound (C) proceeds. Accordingly, a coating layer having high tightness is formed, and thus-formed coating layer firmly attaches to the core of the carrier particle. Or alternatively, the compound (B) may be subjected to the (co)hydrolytic condensation reaction alone or with the organometallic compound (C) before the formation of the coating layer. In this manner, the volatilization of the compound (B) and the compound (C) can be prevented when being applied onto the surface of the core, thereby forming a coating layer for a short time. In the case of using a low-molecular compound as the organic compound (A), the compound (B) and/or the organometallic compound (C) are preferably subjected to a (co)hydrolytic condensation reaction before being applied onto the surface of the core.

An organometallic compound (C) is not specifically limited as far as the following formula (C) is satisfied:

$$R^2_m M(OR^3)_n \quad (C)$$

wherein M is Si or a metal element; $R^2$ is the same or different hydrogen atom, a lower alkyl group, an allyl group, a mercapto group directly bonded with a vinyl group or a carbon chain, or (meth)acryloyl group; $R^2$ is an identical or different hydrogen atom, a lower alkyl group, or an acryl group; m is 0 or a positive integer; n is an integer of 1 or more; and (m+n) is equal to the valency of metal element M.

By using the organometallic compound (C), the adhesion of the coating layer to the core is improved. The organometallic compound (C) forms tight coating layer with the compound (B) cooperatively, so that the properties of the carrier particles are not deteriorated while the heat resistance thereof is enhanced.

Specific examples of the organometallic compound include: silane compounds such as tetramethoxysilane, tetraethoxysilane, tetraisopropoxysilane, tetrabutoxysilane, methyltrimethoxysilane, methyltriethoxysilane, methyltriisopropoxysilane, methyltributoxysilane, ethyltrimethoxysilane, ethyltriethoxysilane, ethyltriisopropoxysilane, ethyltributoxysilane, dimethyldimethoxysilane, dimethyldiethoxysilane, dimethyldiisopropoxysilane, dimethyldibutoxysilane, diethyldimethoxysilane, diethyldiethoxysilane, diethyldiisopropoxysilane, diethyldibutoxysilane; titanium alkoxides such as titanium tetraethoxide, titanium tetraisopropoxide, titanium tetrabutoxide and the like; zirconium alkoxides such as zirconium tetraethoxide, zirconium tetraisopropoxide, zirconium tetrabutoxide and the like; and aluminum alkoxides such as aluminum triethoxide, aluminum triisopropoxide, aluminum tributoxide and the like. These compounds may be used alone or in a mixture of two or more of them. Especially preferable are tetramethoxysilane and tetraethoxysilane, because the obtained coating layer exhibits excellent humidity resistance.

The hydrolytic condensation reaction of the compound (B) and/or the organometallic compound (C) can be conducted in the presence of the moisture in the air, or may be conducted by adding a known catalyst including acids or bases. It is advantageous for the application of the coating material onto the core that the hydrolytic condensation reaction of the compound (B) and/or the organometallic compound (C) is conducted in a solvent (D), which will be described later.

In the present invention, the coating material applied to the carrier particle to form a coating layer includes the organic compound (A), the compound (B), the organometallic compound (C), and the solvent (D). Hereinafter, the preferable amount of the compounds (A), (B), and (C) respectively will be described, on the assumption that the total amount of the compounds (A), (B), and (C) other than the solvent (D) is defined as 100 wt %.

The preferable amount of the organic compound (A) is in the range between 1 and 40 wt %. With the amount of less than 1 wt %, the obtained coating layer has only insufficient flexibility, so that the impact resistance may be insufficient. Contrary to this, with the amount of larger than 40 wt %, toner is likely to attach to the carrier particle. More preferable amount of the organic compound (A) used is in the range between 5 and 30 wt %, and the most preferably in the range between 5 and 20 wt %. The preferable amount of the compound (B) is in the range between 0.5 and 80 wt %. With the amount of less than 0.5 wt %, a coating layer does not sufficiently adhere to the surface of the core of the carrier particle. Contrary to this, with the amount of larger than 80 wt %, the obtained coating layer may have only insufficient humidity resistance. More preferable amount of the compound (B) is in the range between 1 and 70 wt %, and the most preferably in the range between 1 and 60 wt %. The preferable amount of the organometallic compound (C) is in the range between 5 and 90 wt %. With the amount of less than 5 wt %, the toner may not be sufficiently charged at high temperature under high humidity. Contrary to this, with the amount of larger than 90 wt %, the amount of the organic compound (B) used becomes small relatively, so that the obtained coating layer has deteriorated flexibility. More preferable amount of the organometallic compound (C) is in the range between 10 and 90 wt %, and the most preferably in the range between 30 and 80 wt %.

The solvent (D) is not limited to a specific kind, and it is preferable to use a solvent which will dissolve or disperse the organic compound (A), the compound (B), and the organometallic compound (C). Examples of the solvent (D) include: alcohols such as methanol, ethanol, 2-propanol, butanol, ethylene glycol and the like; ketones such as acetone, methyl ethyl ketone, methyl isobutyl ketone and the like; aromatic hydrocarbons such as toluene, benzene, xylene and the like; hydrocarbons such as hexane, heptane, octane and the like; esters such as ethyl acetate, butyl acetate and the like; and other solvents such as tetrahydrofuran, propyl ether, water and the like. These solvents may be used alone or in a mixture of two or more of them. The amount of the solvent used is not limited to a specific value, and the concentration of the solid content of the coating material is adjusted when the coating material is applied onto the core of the carrier particles in such a manner that the coating layer having proper thickness is formed.

The method for preparing the coating material is not specifically limited. For example, the compound (A), the compound (B) and/or its hydrolytic condensation product, and the compound (C) and/or it hydrolytic condensation product are mixed with each other; the compound (A) and the compound (B) are reacted first, and then, the compound (C) and/or its hydrolytic condensation product is added thereto; the compound (B) and the compound (C) are subjected to cohydrolytic condensation polymerization in the presence of the compound (A); and the compound (B) and the compound (C) is subjected to cohydrolytic condensation reaction, and then, the compound (A) is reacted therewith.

The coating material applied onto the surface of the carrier particle to form a coating layer may contain a silicone resin (E). The silicone resin (E) is not limited to a specific kind. Examples of commercially available silicone resins include: TSR-127B, TSR-144, and the like (product names: manufactured by Toshiba-Silicone KK), SR-2406, SR-2410, SR-2411, and the like (product names: manufactured by Toray-Dow Corning-Silicone-KK), KR-255, KR-271, and the like (product names: manufactured by Shin-etsu-Kagaku-Kogyo-KK), and the like. Normally, the preferable amount of the silicone resin (E) is in the range between 0.01 and 50 wt %, and more preferably in the range between 0.1 and 50 wt % with respect to the total amount of the coating material.

As far as the effect of the present invention is not impaired, the coating material may be provided with various inorganic and organic additive agents such as a curing catalyst, a wettability improving agent, a plasticizer, a defoaming agent, a thickner, and the like.

As described above, the carrier particle for use in electrostatic image development comprises the core and the coating layer formed on the surface of the core, and the layer is made of the coating material. The kind of core is not limited to a specific kind, and examples thereof include metallic particles containing elements such as magnesium, calcium, titanium, zirconium, iron, vanadium, molybdenum, tungsten, zinc, aluminum, silicon, tin, and the like, or particles containing an oxide thereof. Preferably used as the core are iron powder, ferrite-type metallic powder, magnetite powder, glass beads, and the like.

In the formation of the carrier particle, a method for applying the above-described coating material onto the surface of the core is not specifically limited, and examples thereof include dip coating, spray coating, pour spray coating using a flow coater, and the like.

Subsequent to the coating material application, the coating layer is cured and dried. When heated or heated in the presence of moisture, the coating layer is cured and dried for shorter time. The preferable thickness of the coating layer is approximately 5 μm or less, and more preferably in the range between 0.1 and 3 μm.

A two-component system electrostatic image developer comprising the carrier particles of the present invention and known toner particles is also in the scope of the present invention. According to the present invention, the coating layer is made of a coating material including the organic compound (A), the hydrolytic polymerizable compound (B) having reactivity with the compound (A), and the hydrolytic polymerizable organometallic compound (C). Thus-formed coating layer, having proper flexibility and high tightness with the excellent impact resistance and abrasion resistance, firmly adhere onto the surface of the core. In combination with this carrier particle, the toner particle is sufficiently charged even at high temperature under high humidity, so that the fogging of the image can be prevented. Moreover, the carrier particle has excellent durability and is helpful for providing a clear image over a long period of time. There is no unnecessary attachment of the toner particles onto the carrier particles, so that the problems of carrier particle contamination and the spent toner never arise. Therefore, the carrier particle of the present invention is suitable for use in a two-component developer used in an electrophotographic copying machine.

EXAMPLES

The present invention will be further described by way of examples, but all the variations and modifications of the examples are in the scope of the present invention as far as the objective thereof is attained.

Example 1

Into a flask equipped with a stirrer, a thermometer, and a cooler, 100 g of γ-aminopropyltrimethoxysilane and 80 g of methanol was poured, and the mixture was heated to 70° C. Subsequently, 11.4 g of resorcinol diglycidyl ether was added dropwide to the flask over 30 minutes. The resultant mixture was ripened at 70° C. for 3 hours and then was cooled to room temperature. After that, a mixture of 2.5 g of water and 30 g of methanol was added thereto, and was stirred at room temperature for 1 hour. Then, the resultant mixture was aged to undergo hydrolytic condensation reaction, and a mixture of 84.9 g of tetramethoxysilane and methanol was added thereto. In this manner, a coating material used for carrier particle was obtained.

Onto the surface of the spherical ferrite particle having a diameter of 100 μm in average, the coating material was applied by pour spraying in such a manner that the coating layer after dried had a thickness of 1.5 μm in average. The particle was heated and cured at 150° C. for 1 hour, so that a carrier particle was produced. 100 weight parts of thus-obtained carrier particle was mixed with 3 weight parts of toner particle containing a styrene-acrylic copolymer as a binder resin to prepare a developer. Using the developer, a running test of 100,000 sheets was conducted by a commercially available copying machine. The running test was conducted at normal temperature under normal humidity (i.e., at 20° C. and 60% Rh), and at high temperature under high humidity (i.e., 30° C. and 90% Rh), respectively. Under both conditions, the clear images with no fog were constantly and stably formed.

Example 2

The procedure of Example 1 was repeated except for using 65.9 g of hydrolytic condensation product of tetramethoxysilane ("SILICATE M51": product name, manufactured by Tama-Kagaku KK) instead of 84.9 g of tetramethoxysilane; whereby a coating material was produced. Repeating the procedure of Example 1, a carrier particle and a developer comprising the carrier particle were produced, and the evaluation was conducted under the same conditions as those of Example 1. Under both conditions, clear image with no fog were constantly and stably formed.

Example 3

The procedure of Example 1 was repeated except for increasing the amount of resorcinol diglycidyl ether to 30 g. Repeating the procedure of Example 1, a carrier particle and a developer comprising the carrier particle were produced, the evaluation was conducted under the same conditions as those of Example 1. Under both conditions, clear images with no fog were constantly and stably formed.

Example 4

The procedure of Example 1 was repeated except for using 10 g of bisphenol A diglycidyl ether instead of using 11.4 g of resorcinol diglycidyl ether. Repeating the procedure of Example 1, a carrier particle and a developer comprising the carrier particle were produced, and the evaluation was conducted under the same conditions as those of Example 1. Under both conditions, clear images with no fog were constantly and stably formed.

Example 5

The procedure of Example 1 was repeated except for using 10 g of ethylene glycol diglycidyl ether instead of using 11.4 g of resorcinol diglycidyl ether. Repeating the procedure of Example 1, a carrier particle and a developer comprising the carrier particle were produced, and the evaluation was conducted under the same conditions as those of Example 1. Under both conditions, clear image with no fog were constantly and stably obtained.

Example 6

100 weight parts of the coating material produced in Example 1 was mixed with 500 weight parts of a silicone resin "KR251" (containing 20 wt % of solid content: product name, manufactured by Shin-etsu-Kagaku-Kogyo Co.); whereby a coating material was produced. Repeating the procedure of Example 1, a carrier particle and a including the carrier particle were produced, and the evaluation was conducted under the same conditions as those of Example 1. Under both conditions, clear images with no fog were constantly and stably obtained.

Example 7

Into a flask equipped with a stirrer, a thermometer, and a cooler, 7.22 g of polyethyleneimine "EPOMIN SP-018" (product name, manufactured by Nippon Shokubai Co.), 3.25 g of γ-glycidoxy-propyltriethoxysilane, and 21.1 g of methanol was pourd, and the mixture was stirred at 65° C. for 2 hours in the nitrogen atmosphere. Subsequently, a mixture of 5 g of methanol and 0.1 g of water was added dropwise to the flask over 15 minutes, and was stirred for 1 hour. Then, the resultant mixture was mixed with a mixture of 52.0 g of tetramethoxysilane and 15.4 g of methanol, and was stirred at room temperature for 3 hours. In this manner, a coating material was obtained. Repeating the procedure of Example 1, a carrier particle and a developer comprising the carrier particle were produced, and the evaluation was conducted under the same conditions as those of Example 1. Under both conditions, clear image with no fog were constantly and stably obtained.

Comparative Example 1

Repeating the procedure of Example 1, a carrier particle and a developer comprising the carrier particle were produced by only using a methanol solution including γ-aminopropyltrimethoxysilane (containing 30 wt % of solid content) as a coating material, and the evaluation was conducted under the same conditions as those of Example 1. At normal temperature under normal humidity, all the images were clear with less fog in the initial stage of the copying operation; however, after copying 100,000 sheets, all the images had much fog. At high temperature under high humidity, all the images had much fog from the beginning of copying operation.

Comparative Example 2

100 weight parts of a methanol solution including γ-aminopropyltrimethoxysilane (containing 30wt % of solid content) was mixed with 26 weight parts of tetramethoxysilane, so that a coating material was obtained. Using the coating material, a carrier particle and a developer including the carrier particle were produced, and the evaluation was conducted under the same conditions as those of Example 1. At normal temperature under normal humidity, clear images with less fog were constantly and stably formed; however, at high temperature under high humidity, all the images had much fog.

What is claimed is:

1. A carrier particle for use in electrostatic image development including a core and a coating layer formed on the surface of the core, wherein the coating layer is made of a coating material comprising:

(A) an polyethyleneimine having two or more functional amino groups, with the proviso that the polyethyleneimine does not contain an $Si(OR^1)$ group, where $R^1$ is a hydrogen atom, a lower alkyl group containing 1 to 4 carbon atoms or an acyl group;

(B) a silane compound and/or a hydrolytic condensation product thereof, having a functional group selected from the group consisting of an epoxy group and a mercapto group, wherein said functional group is reactive with the functional amino groups of the polyethyleneimine (A), and an $Si(OR^1)$ group, where $R^1$ is a hydrogen atom, a lower alkyl group containing 1 to 4 carbon atoms or an acyl group;

(C) an organometallic compound of the formula (C) and/or a hydrolytic condensation product thereof:

$$R^2{}_mM(OR^3)_n \quad (C)$$

wherein M is Si or a metal element; $R^2$ is the same or different hydrogen atom, a lower alkyl group containing 1 to 4 carbon atoms or an allyl group; $R^3$ is the same or different hydrogen atom, a lower allyl group containing 1 to 4 carbon atoms or an acyl group; m is 0 or a positive integer; n is an integer of 1 or more; and (m+n) is equal to the valency of element M; and (D) a solvent.

2. The carrier particle according to claim 1, wherein compound (B) is selected from the group consisting of β-(3,4-epoxycyclohexyl) ethyl-trimethoxysilane, β-(3,4-epoxycyclohexyl) ethyl-triethoxysilane, β-(3,4-epoxycyclohexyl) ethyl-triisopropoxysilane, β-(3,4-epoxycyclohexyl) ethyl-methyl-dimethoxysilane, β-(3,4-epoxycyclohexyl) ethyl-methyl-diethoxysilane, γ-glycidoxy-propyl-trimethoxysilane, γ-glycidoxy-propyl-triethoxysilane, γ-glycidoxy-propyl-triisopropoxysilane, γ-glycidoxy-propyl-methyl-dimethoxysilane, γ-glycidoxy-propyl-methyl-diethoxysilane and mixtures thereof.

3. The carrier particle according to claim 1, wherein compound (C) is selected from the group consisting of tetramethoxysilane, tetraethoxysilane, tetraisopropoxysilane, tetrabutoxysilane, methyltrimethoxysilane, methyltriethoxysilane, methyltriisopropoxysilane, methyltributoxysilane, ethyltrimethoxysilane, ethyltriethoxysilane, ethyltriisopropoxysilane, ethyltributoxysilane, dimethyldimethoxysilane, dimethyldiethoxysilane, dimethyldiisopropoxysilane, dimethyldibutoxysilane, diethyldimethoxysilane, diethyldiethoxysilane, diethyldiisopropoxysilane, diethyldibutoxysilane, titanium tetraethoxide, titanium tetraisopropoxide, titanium tetrabutoxide, zirconium tetraethoxide, zirconium tetraisopropoxide, zirconium tetrabutoxide, aluminium triethoxide, aluminum triisopropoxide, aluminum tributoxide and mixtures thereof.

4. The carrier particle according to claim 1, comprising a cohydrolytic condensation product of the compound (B) with the organometallic compound (C).

5. An electrostatic image developer comprising the carrier particle of claim 1 and toner particles.

6. A carrier particle for use in electrostatic image development including a core and a coating layer formed on the surface of the core, wherein the coating layer is made of a coating material comprising:

(A) an organic compound having a functional group selected from the group consisting of an amino group and an epoxy group with the proviso that the organic compound does not contain an $Si(OR^1)$ group, where $R^1$ is a hydrogen atom, a lower alkyl group containing 1 to 4 carbon atoms or an acyl group;

(B) a silane compound and/or a hydrolytic condensation product thereof, having a functional group selected from the group consisting of an amino group, an epoxy group and a mercapto group, wherein said functional group is reactive with the functional group of the organic compound (A), and an $Si(OR^1)$ group, where $R^1$ is a hydrogen atom, a lower alkyl group containing 1 to 4 carbon atoms or an acyl group;

(C) an organometallic compound of the formula (C) and/or a hydrolytic condensation product thereof:

$$R^2{}_mM(OR^3)_n \quad (C)$$

wherein M is Si or a metal element; $R^2$ is the same or different hydrogen atom, a lower alkyl group containing 1 to 4 carbon atoms or an allyl group; $R^3$ is the same or different hydrogen atom, a lower alkyl group containing 1 to 4 carbon atoms or an acyl group; m is 0 or a positive integer; n is an integer of 1 or more; and (m+n) is equal to the valency of element M;

(D) a solvent, and (E) a silicone resin.

7. The carrier particle according to claim 6, wherein the organic compound (A) has two or more functional groups.

8. The carrier particle according to claim 7, wherein compound (B) is selected from the group consisting of β-(3,4-epoxycyclohexyl) ethyl-trimethoxysilane, β-(3,4

-epoxycyclohexyl) ethyl-triethoxysilane, β-(3,4-epoxycyclohexyl) ethyl-triisopropoxysilane, β-(3,4-epoxycyclohexyl) ethyl-methyl-dimethoxysilane, β-(3,4-epoxycyclohexyl) ethyl-methyl-diethoxysilane, γ-glycidoxy-propyl-trimethoxysilane, γ-glycidoxy-propyl-triethoxysilane, γ-glycidoxy-propyl-triisopropoxysilane, γ-glycidoxy-propyl-methyl-dimethoxysilane, γ-glycidoxy-propyl-methyl-diethoxysilane and mixtures thereof.

9. The carrier particle according to claim 6, wherein the organic compound (A) has two or more epoxy groups.

10. The carrier particle according to claim 6, wherein the organic compound (A) is a diglycidyl compound having an aromatic ring or a hydrogen addition ring thereof.

11. The carrier particle according to claim 6, wherein the organic compound (A) has two or more amino groups.

12. The carrier particle according to claim 11, wherein compound (B) is selected from the group consisting of β-(3,4-epoxycyclohexyl) ethyl-trimethoxysilane, β-(3,4-epoxycyclohexyl) ethyl-triethoxysilane, β-(3,4-epoxycyclohexyl) ethyl-triisopropoxysilane, β-(3,4-epoxycyclohexyl) ethyl-methyl-dimethoxysilane, β-(3,4-epoxycyclohexyl) ethyl-methyl-diethoxysilane, γ-glycidoxy-propyl-trimethoxysilane, γ-glycidoxy-propyl-triethoxysilane, γ-glycidoxy-propyl-triisopropoxysilane, γ-glycidoxy-propyl-methyl-dimethoxysilane, γ-glycidoxy-propyl-methyl-diethoxysilane and mixtures thereof.

13. The carrier particle according to claim 6, wherein the compound (B) is selected from the group consisting of N-β-(aminoethyl)-γ-aminopropyltrimethoxysilane, N-β-(aminoethyl)-γ-aminopropyltriethoxysilane, N-β-(aminoethyl)-γ-amino-propyl-triisopropoxysilane, N-β-(aminoethyl)-γ-amino-propyl-tributoxysilane, N-β-(aminoethyl)-γ-amino-propyl-methyldimethoxysilane, N-β-(aminoethyl)-γ-amino-propyl-methyldiethoxysilane, N-β-(aminoethyl)-γ-amino-propyl-methyldiisopropoxysilane, N-β-(aminoethyl)-γ-amino-propyl-methyldibutoxysilane, N-β-(aminoethyl)-γ-amino-propyl-ethyldimethoxysilane, N-β-(aminoethyl)-γ-amino-propyl-ethyldiethoxysilane, N-β-(aminoethyl)-γ-amino-propyl-ethyldiisopropoxysilane, N-β-(aminoethyl)-γ-amino-propyl-ethyldibutoxysilane, γ-amino-propyl-trimethoxysilane, γ-amino-propyl-triethoxysilane, γ-amino-propyl-triisopropoxysilane, γ-amino-propyl-tributoxysilane, γ-amino-propyl-methyldimethoxysilane, γ-amino-propyl-methyldiethoxysilane, γ-amino-propyl-methyldiisopropoxysilane, γ-amino-propyl-methyldibutoxysilane, γ-amino-propyl-ethyldimethoxysilane, γ-amino-propyl-ethyldiethoxysilane, γ-amino-propyl-ethyldiisopropoxysilane, γ-amino-propyl-ethyldibutoxysilane, γ-amino-propyl-triacetoxysilane, γ-(2-ureidoethyl)amino-propyl-trimethoxysilane, γ-(2-ureidoethyl)amino-propyl-triethoxysilane, γ-ureidopropyltriethoxysilane, N-β-(N-vinylbenzilaminoethyl)-γ-amino-propyl-trimethoxysilane and mixtures thereof.

14. A carrier particle for use in electrostatic image development according to claim 6, wherein compound (B) is selected from the group consisting of γ-mercapto propyltrimethoxysilane, γ-mercaptopropyltriethoxysilane and mixtures thereof.

15. The carrier particle according to claim 6, wherein compound (C) is selected from the group consisting of tetramethoxysilane, tetraethoxysilane, tetraisopropoxysilane, tetrabutoxysilane, methyltrimethoxysilane, methyltriethoxysilane, methyltriisopropoxysilane, methyltributoxysilane, ethyltrimethoxysilane, ethyltriethoxysilane, ethyltriisopropoxysilane, ethyltributoxysilane, dimethyldimethoxysilane, dimethyldiethoxysilane, dimethyldiisopropoxysilane, dimethyldibutoxysilane, diethyldimethoxysilane, diethyldiethoxysilane, diethyldiisopropoxysilane, diethyldibutoxysilane, titanium tetraethoxide, titanium tetraisopropoxide, titanium tetrabutoxide, zirconium tetraethoxide, zirconium tetraisopropoxide, zirconium tetrabutoxide, aluminium triethoxide, aluminum triisopropoxide, aluminum tributoxide and mixtures thereof.

16. The carrier particle according to claim 6, comprising a cohydrolytic condensation product of the compound (B) with the organometallic compound (C).

17. An electrostatic image developer comprising the carrier particle of claim 6 and toner particles.

18. A carrier particle for use in electrostatic image development including a core and a coating layer formed on the surface of the core, wherein the coating layer is made of a coating material comprising:

(A) an organic compound having two or more epoxy functional groups, with the proviso that the organic compound does not contain an $Si(OR^1)$ group, where $R^1$ is a hydrogen atom, a lower alkyl group containing 1 to 4 carbon atoms or an acyl group;

(B) a silane compound and/or a hydrolytic condensation product thereof, having a mercapto functional group, wherein said functional group is reactive with the functional group of the organic compound (A), and an $Si(OR^1)$ group, where $R^1$ is a hydrogen atom, a lower alkyl group containing 1 to 4 carbon atoms or an acyl group;

(C) an organometallic compound of the formula (C) and/or a hydrolytic condensation product thereof:

$$R^2_m M(OR^3)_n \quad (C)$$

wherein M is Si or a metal element; $R^2$ is the same or different hydrogen atom, a lower alkyl group containing 1 to 4 carbon atoms or an allyl group; $R^3$ is the same or different hydrogen atom, a lower alkyl group containing 1 to 4 carbon atoms or an acyl group; m is 0 or a positive integer; n is an integer of 1 or more; and (m+n) is equal to the valency of element M; and (D) a solvent.

19. An electrostatic image developer comprising the carrier particle of claim 18 and toner particles.

20. A carrier particle for use in electrostatic image development including a core and a coating layer formed on the surface of the core, wherein the coating layer is made of a coating material comprising:

(A) an organic epoxy compound selected from the group consisting of ethylene glycol diglycidyl ether, diethylene glycol diglycidyl ether, triethylene glycol diglycidyl ether, tetraethylene glycol diglycidyl ether, nonaethylene glycol diglycidyl ether, propylene glycol diglycidyl ether, dipropylene glycol diglycidyl ether, tripropylene glycol diglycidyl ether, 1,6-hexanediol diglycidyl ether, neopentyl glycol diglycidyl ether, glycerol diglycidyl ether, glycerol triglycidyl ether, diglycerol triglycidyl ether, triglycidyl tris(2-hydroxyethyl) isocyanurate, trimethylolpropane triglycidyl ether, pentaerythritol tetraglycidyl ether, diglycidyl adipate, diglycidyl o-phthalate, bisphenol A diglycidyl ether, resorcinol diglycidyl ether, hydroquinone diglycidyl ether, bisphenol S diglycidyl ether, bisphenol F diglycidyl ether, compounds represented by the following formulae:

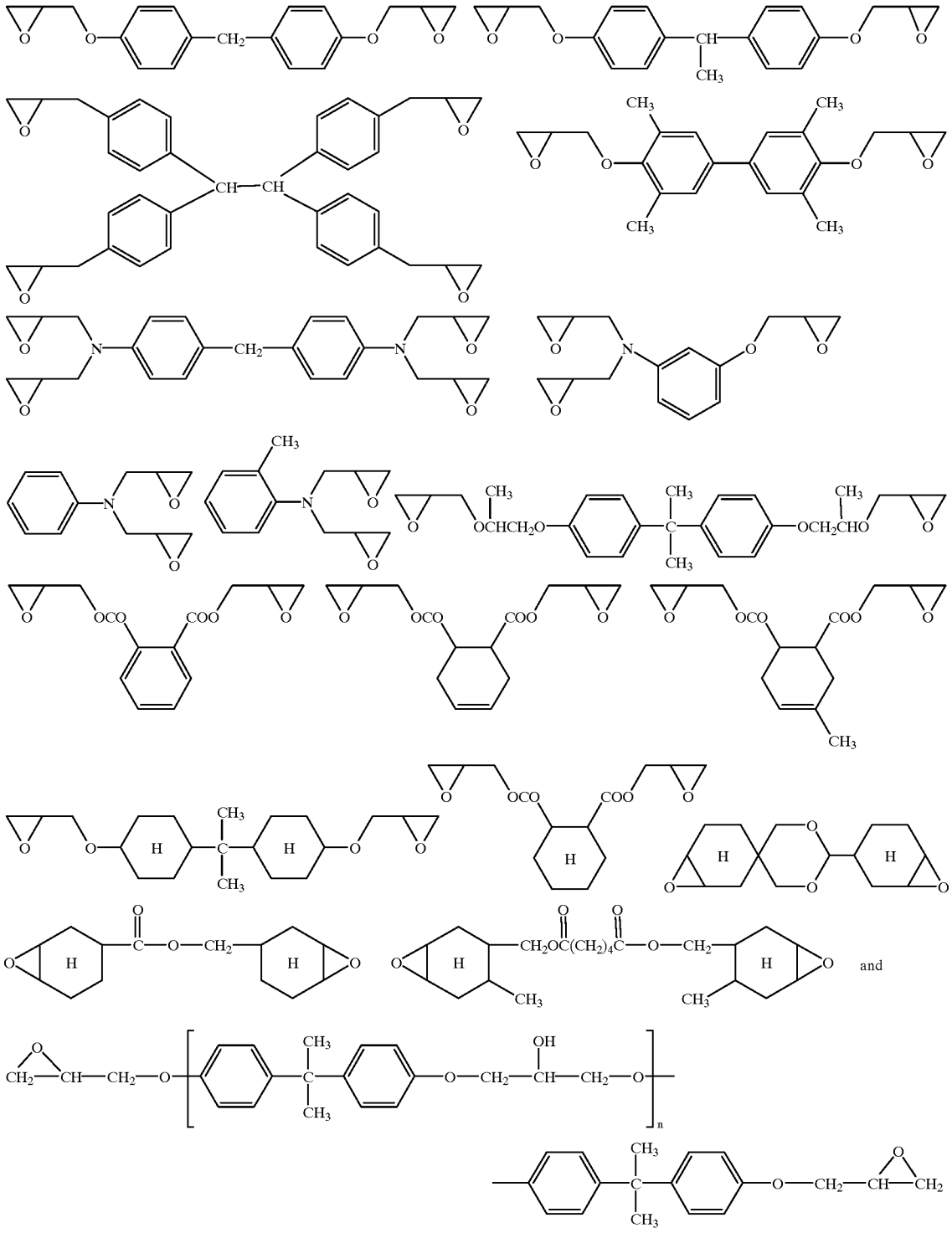

wherein n=0 or an integer of 1 or more;

(B) a silane compound and/or a hydrolytic condensation product thereof, having a functional group selected from the group consisting of an amino group and a mercapto group, wherein said functional group is reactive with the epoxy functional group of the organic compound (A), and an $Si(OR^1)$ group, where $R^1$ is a hydrogen atom, a lower alkyl group containing 1 to 4 carbon atoms or an acyl group;

(C) an organometallic compound of the formula (C) and/or a hydrolytic condensation product thereof:

$$R^2_mM(OR^3)_n \quad (C)$$

wherein M is Si or a metal element; $R^2$ is the same or different hydrogen atom, a lower alkyl group containing 1 to 4 carbon atoms or an allyl group; $R^3$ is the same or different hydrogen atom, a lower alkyl group containing 1 to 4 carbon atoms or an acyl group; m is 0 or a positive integer; n is an integer of 1 or more; and (m+n) is equal to the valency of element M; and (D) a solvent.

21. The carrier particle according to claim 20, wherein the compound (B) is selected from the group consisting of N-β-(aminoethyl)-γ-aminopropyltrimethoxysilane, N-β-(aminoethyl)-γ-aminopropyltriethoxysilane, N-β-(aminoethyl)-γ-amino-propyl-triisopropoxysilane, N-β-(aminoethyl)-γ-amino-propyl-tributoxysilane, N-β-(aminoethyl)-γ-amino-propyl-methyldimethoxysilane, N-β-(aminoethyl)-γ-amino-propyl-methyldiethoxysilane, N-β-(aminoethyl)-γ-amino-propyl-methyldiisopropoxysilane, N-β-(aminoethyl)-γ-amino-propyl-methyldibutoxysilane, N-β-(aminoethyl)-γ-amino-propyl-ethyldimethoxysilane, N-β-(aminoethyl)-γ-amino-propyl-ethyldiethoxysilane, N-β-(aminoethyl)-γ-amino-propyl-ethyldiisopropoxysilane, N-β-(aminoethyl)-γ-amino-propyl-ethyldibutoxysilane, γ-amino-propyl-trimethoxysilane, γ-amino-propyl-triethoxysilane, γ-amino-propyl-triisopropoxysilane, γ-amino-propyl-tributoxysilane, γ-amino-propyl-methyldimethoxysilane, γ-amino-propyl-methyldiethoxysilane, γ-amino-propyl-methyldiisopropoxysilane, γ-amino-propyl-methyldibutoxysilane, γ-amino-propyl-ethyldimethoxysilane, γ-amino-propyl-ethyldiethoxysilane, γ-amino-propyl-ethyldiisopropoxysilane, γ-amino-propyl-ethyldibutoxysilane, γ-amino-propyl-triacetoxysilane, γ-(2-ureidoethyl)amino-propyl-trimethoxysilane, γ-(2-ureidoethyl)amino-propyl-triethoxysilane, γ-ureidopropyltriethoxysilane, N-β-(N-vinylbenzilaminoethyl)-γ-amino-propyl-trimethoxysilane and mixtures thereof.

22. The carrier particle according to claim 20, wherein compound (C) is selected from the group consisting of tetramethoxysilane, tetraethoxysilane, tetraisopropoxysilane, tetrabutoxysilane, methyltrimethoxysilane, methyltriethoxysilane, methyltriisopropoxysilane, methyltributoxysilane, ethyltrimethoxysilane, ethyltriethoxysilane, ethyltriisopropoxysilane, ethyltributoxysilane, dimethyldimethoxysilane, dimethyldiethoxysilane, dimethyldiisopropoxysilane, dimethyldibutoxysilane, diethyldimethoxysilane, diethyldiethoxysilane, diethyldiisopropoxysilane, diethyldibutoxysilane, titanium tetraethoxide, titanium tetraisopropoxide, titanium tetrabutoxide, zirconium tetraethoxide, zirconium tetraisopropoxide, zirconium tetrabutoxide, aluminium triethoxide, aluminum triisopropoxide, aluminum tributoxide and mixtures thereof.

23. The carrier particle according to claim 20, comprising a cohydrolytic condensation product of the compound (B) with the organometallic compound (C).

24. An electrostatic image developer comprising the carrier particle of claim 20 and toner particles.

25. A carrier particle for use in electrostatic image development including a core and a coating layer formed on the surface of the core, wherein the coating layer is made of a coating material comprising:

(A) an organic amine-containing polymer having a molecular weight of 200 or more selected from the group consisting of polyallylamine, homopolymers of amino group-containing (meth)acrylate, copolymers of amino group-containing (meth)acrylate, and polyoxyethylenealkylamine, wherein the organic amine-containing polymer does not contain an $Si(OR^1)$ group, where $R^1$ is a hydrogen atom, a lower alkyl group containing 1 to 4 carbon atoms or an acyl group;

(B) a silane compound and/or a hydrolytic condensation product thereof, having an epoxy functional group, wherein said epoxy functional group is reactive with the amine functional group of the amine-containing polymer (A), and an $Si(OR^1)$ group, where $R^1$ is a hydrogen atom, a lower alkyl group containing 1 to 4 carbon atoms or an acyl group;

(C) an organometallic compound of the formula (C) and/or a hydrolytic condensation product thereof:

$$R^2_mM(OR^3) \qquad (C)$$

wherein M is Si or a metal element; $R^2$ is the same or different hydrogen atom, a lower alkyl group containing 1 to 4 carbon atoms or an allyl group; $R^3$ is the same or different hydrogen atom, a lower alkyl group containing 1 to 4 carbon atoms or an acyl group; m is 0 or a positive integer; n is an integer of 1 or more; and (m+n) is equal to the valency of the element M; and (D) a solvent.

26. The carrier particle according to claim 25, wherein compound (B) is selected from the group consisting of β-(3,4-epoxycyclohexyl) ethyl-trimethoxysilane, β-(3,4-epoxycyclohexyl) ethyl-triethoxysilane, β-(3,4-epoxycyclohexyl) ethyl-triisopropoxysilane, γ-(3,4-epoxycyclohexyl) ethyl-methyl-dimethoxysilane, β-(3,4-epoxycyclohexyl) ethyl-methyl-diethoxysilane, γ-glycidoxy-propyl-trimethoxysilane, γ-glycidoxy-propyl-triethoxysilane, γ-glycidoxy-propyl-triisopropoxysilane, γ-glycidoxy-propyl-methyl-dimethoxysilane, γ-glycidoxy-propyl-methyl-diethoxysilane and mixtures thereof.

27. The carrier particle according to claim 25, wherein compound (C) is selected from the group consisting of tetramethoxysilane, tetraethoxysilane, tetraisopropoxysilane, tetrabutoxysilane, methyltrimethoxysilane, methyltriethoxysilane, methyltriisopropoxysilane, methyltributoxysilane, ethyltrimethoxysilane, ethyltriethoxysilane, ethyltriisopropoxysilane, ethyltributoxysilane, dimethyldimethoxysilane, dimethyldiethoxysilane, dimethyldiisopropoxysilane, dimethyldibutoxysilane, diethyldimethoxysilane, diethyldiethoxysilane, diethyldiisopropoxysilane, diethyldibutoxysilane, titanium tetraethoxide, titanium tetraisopropoxide, titanium tetrabutoxide, zirconium tetraethoxide, zirconium tetraisopropoxide, zirconium tetrabutoxide, aluminium triethoxide, aluminum triisopropoxide, aluminum tributoxide and mixtures thereof.

28. The carrier particle according to claim 25, comprising a cohydrolytic condensation product of the compound (B) with the organometallic compound (C).

29. An electrostatic image developer comprising the carrier particle of claim 25 and toner particles.

* * * * *